United States Patent [19]

Romagnoli

[11] 4,382,355

[45] May 10, 1983

[54] APPARATUS FOR THE APPLICATION OF A THREAD HAVING A LABEL ATTACHED TO IT TO A STRIP OF FILTER PAPER IN A MACHINE FOR THE AUTOMATIC PRODUCTION OF FILTER BAGS FOR THE PRODUCTS TO BE INFUSED

[75] Inventor: Andrea Romagnoli, Bologna, Italy

[73] Assignee: I.M.A. - Industria Macchine Automatiche S.p.A., Bologna, Italy

[21] Appl. No.: 227,767

[22] Filed: Jan. 23, 1981

Related U.S. Application Data

[63] Continuation-in-part of Ser. No. 51,655, Jun. 25, 1979, Pat. No. 4,288,224.

[30] Foreign Application Priority Data

Mar. 6, 1979 [IT] Italy ..... 3341 A/79

[51] Int. Cl.[3] ..... B65B 29/04

[52] U.S. Cl. ..... 53/134; 493/375

[58] Field of Search ..... 53/134, 135; 493/375, 493/345, 961

[56] References Cited

U.S. PATENT DOCUMENTS

| | | | |
|---|---|---|---|
| 1,752,730 | 4/1930 | Carlson | 493/375 X |
| 2,334,256 | 11/1943 | Eaton | 53/134 X |
| 2,360,510 | 10/1944 | Murray | 53/134 X |
| 3,566,573 | 3/1971 | Irmscher | 53/134 X |
| 3,805,483 | 4/1974 | Romagnoli | 53/134 |

FOREIGN PATENT DOCUMENTS

| | | | |
|---|---|---|---|
| 704669 | 3/1965 | Canada | 53/134 |
| 1281927 | 10/1968 | Fed. Rep. of Germany | 53/134 |

*Primary Examiner*—James F. Coan

*Attorney, Agent, or Firm*—Karl F. Ross; Herbert Dubno

[57] ABSTRACT

Apparatus for the application of a suspension thread of natural fibers having a label attached to it to a strip of filter paper in a machine for the automatic production of filter bags of an infusion product operating in conjunction with a label feeding device. The filter paper strip is coated with a thin layer of thermoplastic material on one of its faces and moves in front of the apparatus connected to the machine which is provided with means for feeding a continuous thread to the said apparatus. This apparatus, in turns, is provided with a head or wheel with radial arms which turns intermittently. Also provided are means for the application of equidistant labels to the thread before the turning head or wheel, so that the thread, set in motion by the same head or wheel carrying a label on each of its arms, crosses all operation stations. Here the thread is first cut before the label, then folded up parallel to itself, and finally connected to the strip for local impregnation on the surface of the strip with the thermoplastic material diffusing by heating effect through the filter paper.

5 Claims, 5 Drawing Figures

101
102
103
104
99
100
48b
48a
105
96
47
97
36
40
35
34
32
44
46
98
33
57
54
54b
55
37
38
62
63
61
64
56
45
59
50
52
42
41
39
43

APPARATUS FOR THE APPLICATION OF A THREAD HAVING A LABEL ATTACHED TO IT TO A STRIP OF FILTER PAPER IN A MACHINE FOR THE AUTOMATIC PRODUCTION OF FILTER BAGS FOR THE PRODUCTS TO BE INFUSED

CROSS-REFERENCE TO RELATED APPLICATIONS

This application is a continuation-in-part of Ser. No. 051,655 filed June 25, 1979 now U.S. Pat. No. 4,288,224 and is also related to copending application Ser. No. 199,682 filed Oct. 22, 1980 as a continuation of now abandoned application Ser. No. 095,544 filed Nov. 19, 1979 as a continuation of Ser. No. 685,031 of May 10, 1976, also abandoned.

FIELD OF THE INVENTION

The present invention relates to an apparatus for applying a suspension thread of natural fibers, having a label attached to it, to a strip of filter paper in machines for the automatic production of filter bags for products to be infused (e.g. tea bags).

BACKGROUND OF THE INVENTION

A filter bag for products to be infused, such as tea, camomile and the like, and a method of producing this filter bag are described in my copending application Ser. No. 199,682.

This filter bag is essentially constituted by folding a piece of filter paper, provided on one of its surfaces with a light coating of thermoplastic material, along a median line in such a way as to form two symmetrical half sections having the thermoplastic coating on its internal surfaces facing one another and by joining the two half sections by heating along their respective edges, so as to create the space for containing the product to be infused.

A suspension thread of natural fiber having a label attached to it can be applied to a filter bag by heating the areas of the filter paper corresponding to the natural fiber thread at the opposite sides of the label disposed on one external face of the bag in which the natural fiber thread is folded parallel to itself in order to be wound around the bag to overlie the other surface, and at one area at least of this latter face and at the edges of the said two half sections of one side of the bag between which the terminal portion of the said natural fiber thread is inserted causing a localized impregnation of the natural fiber thread with the thermoplastic material of the coating layer inside the bag and which diffuses through the filter paper following this heating operation.

The connection of the natural fiber thread to the filter paper bag obtained in this way is sufficiently stable to ensure that the bag may be handled without problems during all the subsequent steps for treating the bag until it is packed in containers for sale to the consumer, the tag may be readily drawn away from the bag at the time of use by the consumer without causing any damage or tearing of the filter paper of the bag.

OBJECTS OF THE INVENTION

The main object of the present invention is to provide an apparatus designed to apply a suspension thread of natural fiber having a label attached to it to a strip of filter paper which may be used in a machine for the automatic production of filter bags for products to be infused of the type and manufactured by the method disclosed in the application Ser. No. 199,682.

Still another object is to extend the principles of application Ser. No. 051,655.

A further object of the present invention is to provide an improved apparatus adapted to attach labels at regular intervals to a continuous natural fiber thread to be used as a suspension thread provided with a label, by cutting the section between two successive labels.

It is also an object of the present invention to provide an apparatus designed to manipulate the said thread in such a way as to fold it parallel to itself so as to enable it to be attached to the strip of filter paper as a suspension thread at the opposite ends of the respective label and at at least one intermediate point so that the label, once the bag has been produced, is applied to one of the surfaces of the bag itself, to the other intermediate point on the opposite surface and has its end between the edges of one side of the bag.

Yet a further object of the present invention is to provide an improved apparatus for the purposes described which is particularly efficient and economical in respect of its output in combination with a machine for the production of filter bags obtained in a completely automatic manner.

SUMMARY OF THE INVENTION

These and other objects which will become apparent hereinafter are attained with the apparatus of the present invention for the application of a suspension thread of natural fiber with a label attached to it to a strip of filter paper in machines for the automatic production of filter bags for products to be infused operating in combination with a label supply device, the strip of filter paper having on one of its surfaces a light layer of thermoplastic material.

The apparatus comprises means for continuously supplying the strip of filter paper along a working line and, disposed along the latter, folding means for folding the strip of filter paper into two symmetrical half sections having the thermoplastic coating on the internal surfaces facing one another, along a longitudinal median line, and dosing means for supplying quantities of the infusion product at uniform distances to the folded strip.

Joining means is provided for joining, by means of heatings (heat sealing), the transversely folded strip between the amounts of infusion product at uniform distances and along the opposite longitudinal edges.

The apparatus also includes means for cutting the strip at the transverse joints, and the labels can comprise thermoplastic material and of V-shape.

According to an essential feature of the invention the apparatus comprises a head or wheel having radial arms disposed downstream of the label-supply device behind the front of the strip of filter paper, each of these radial arms being associated in the plane of rotation of the head or wheel with thread guide means and a series of three nippers, one downstream and two upstream in respect of the direction of rotation of the rotary head of wheel.

The apparatus also includes means for discontinuously driving the rotary head or wheel having radial arms. Means associated with the drive means is provided for the continuous supply of the filter paper strip and is designed to stop feeding the strip of filter paper in synchronism with the stop phase of each intermittent movement of the rotary head of wheel having radial arms. Tappet or cam means causes the series of nippers to open and close and a guide channel means is joined in a coplanar manner between the said thread guide means and the nippers of the arms of the rotary head or wheel and the said label supply device.

A first working station comprising means including nippers provided along the said guide channel means can cause the tag to be affixed to the thread while supply means supplies a continuous natural fiber thread to the said thread guide means between the said nippers located between the nipper joining means and through the said guide channel means.

First oscillating nipper means is designed to take, under the action of control means, in uniform succession single labels having a V-shape from the label supply device and to transfer them to the said first working station between the said nipper joining means with the said continuous thread between the V-shaped limbs of the labels.

The control means can include means for actuating the said nipper joining means in order to fix by means of heating the labels to the continuous thread, the labels fixed in this way to the continuous thread being caused to move, by two of the three nippers, between the thread guide means of each radial arm as a result of the movement of rotation of the discontinuously rotatable head or wheel and thus being disposed in the plane of rotation between the said two nippers. Second and third operating stations are provided along the path of rotation of the rotary head or wheel having radial arms at one of the radial arms and respectively between two successive radial arms opposite the strip of filter paper in rest positions of the said intermittently rotatable head or wheel. The second working station comprises cutting means designed to cut the continuous thread downstream of the two nippers.

The pin means movable perpendicularly to the plane of rotation of the rotary head or wheel, intersects under the action of control means, the plane of the thread externally to the thread at the nipper upstream of the said two nippers, while thread tensioning means moves the section of thread upstream of the third nipper from its plane and second oscillating nipper means designed, under the action of control means, to grip the label between the said two nippers and oscillate with a movement which is opposite to the rotary movement of the rotary head or wheel thus introducing the said label between the prongs of the said third nipper and winding the thread about the movable pin means.

The said third working station comprises suction means extending along the path of the filter paper strip designed, by means of suction across the filter paper strip, to cause the thread to adhere to the sltrip at the area of the label and at least one other point upstream of the label so that joining means of movable type, under the action of control means, can heat the two areas at which the thread adheres to the filter paper strip causing a localized impregnation of the natural fiber thread with the thermoplastics material of the coating layer of the strip by diffusion through the filter paper as a result of the heating operation.

SPECIFIC DESCRIPTION

Figure 1:
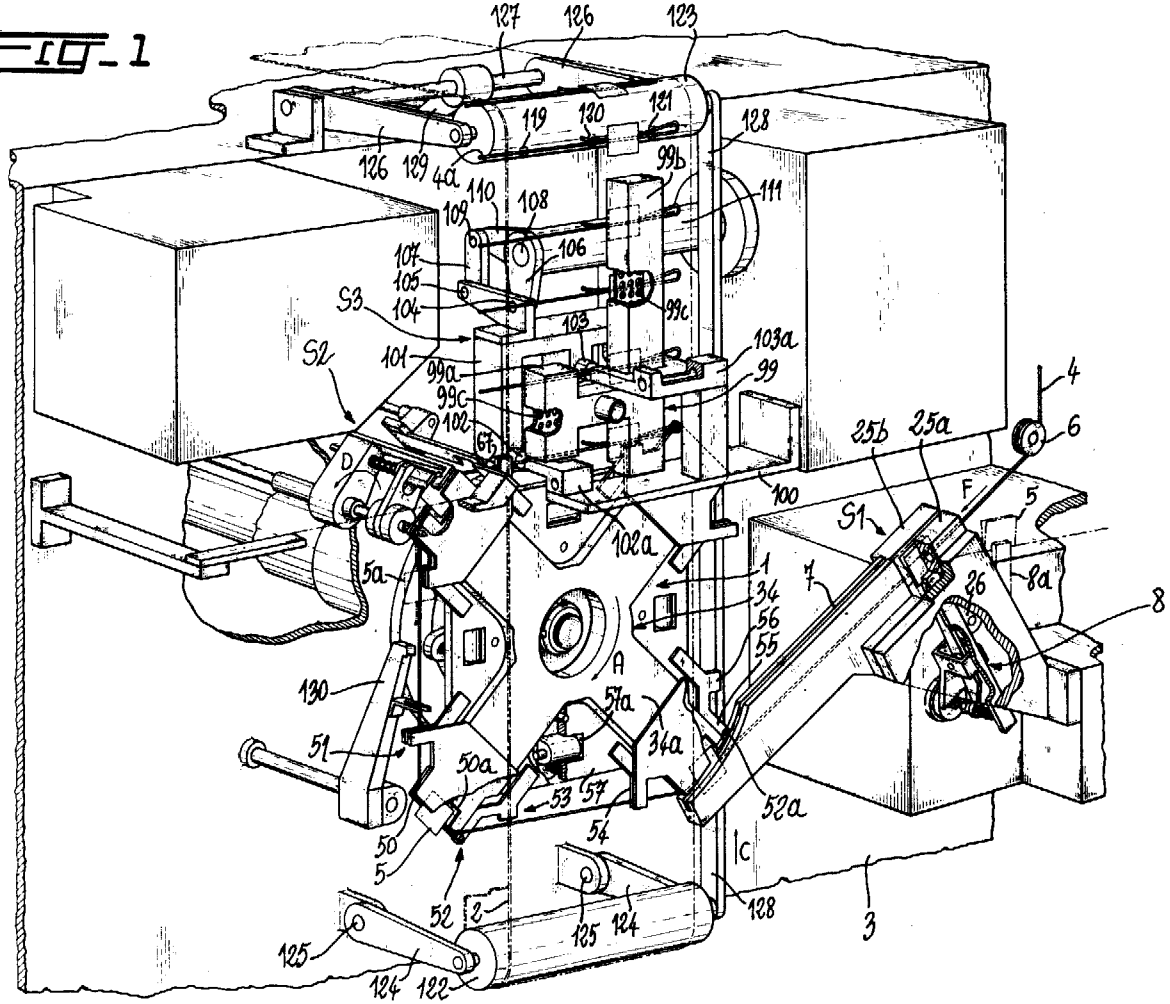
FIG. 1 is a front perspective view of the apparatus according to the invention for the automatic production of filter bags for tea.
Figure 1A:
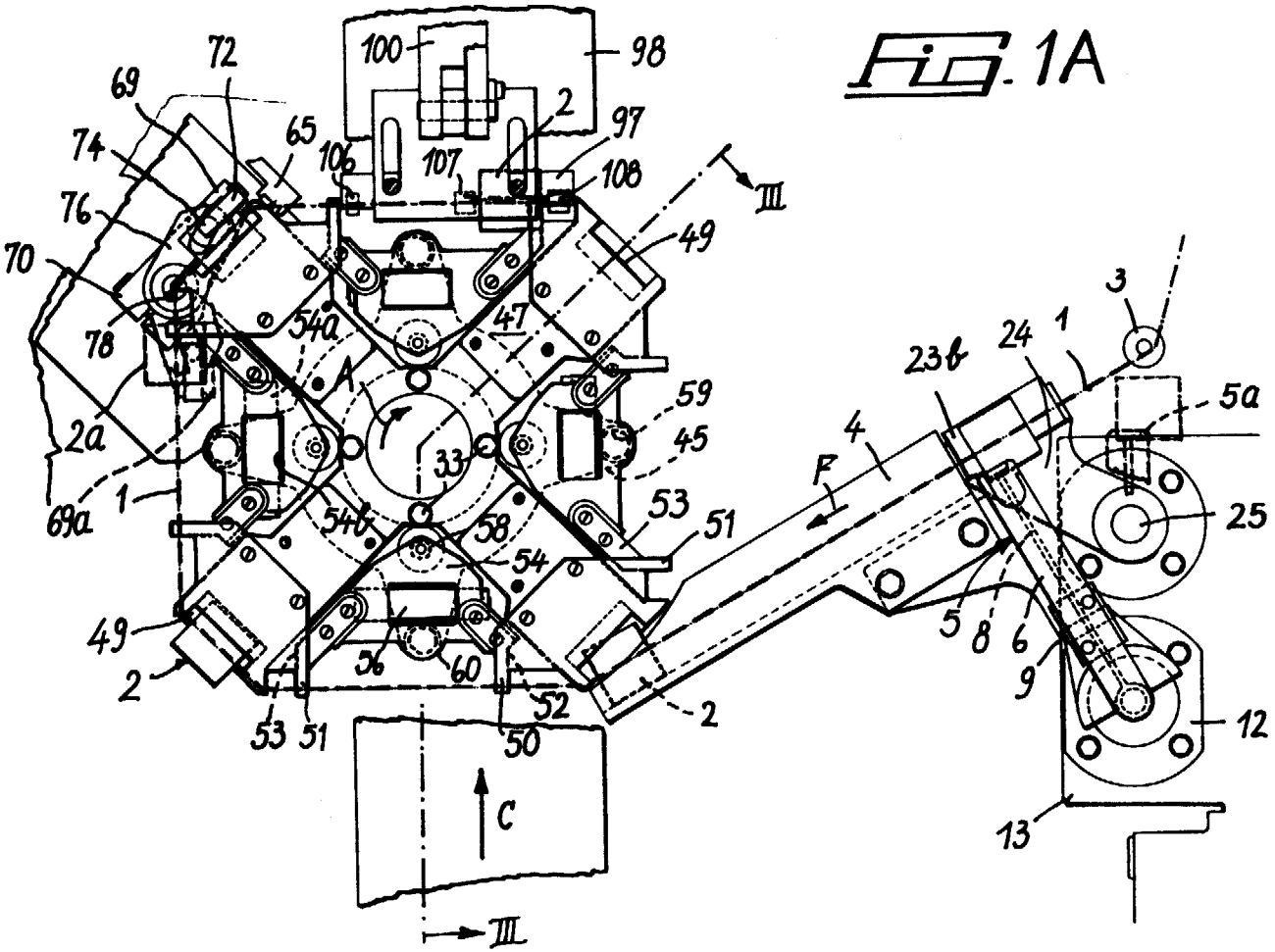
FIG. 1A is a front elevational view of the arms of this apparatus.

With reference to these figures, and in particular in the first instance FIGS. 1 and 1A from which it can be seen that the machine for the automatic production of filter bags is only illustrated in its part which is directly concerned with the apparatus of the present invention, it may also be seen that the latter, indicated in its entirety by 1, is disposed in this machine on the path of the filter paper strip 2, shown for the sake of clarity by dot-dash lines, with its front located behind the strip 2.

The filter paper strip 2 is of the type having on one of its surfaces a light coating layer of thermoplastics material on its exterior in respect of the apparatus 1, and the machine of known type substantially comprises supported on its base 3, upstream of the apparatus 1, means for continuously supplying the filter paper strip 2 along a working line and, disposed along this working line, folding means designed to fold, along a longitudinal median line, the filter paper strip 2 into two symmetrical half sections having the thermoplastics material coated surfaces facing each other internally, dosing means for supplying doses of infusion product, and in this case tea, at uniform distances along the said folded strip 2, joining means for joining, by means of heating, the said strip folded in this way and thus containing doses of tea, transversely between the said uniformly spaced doses and along its opposite longitudinal edges, and cutting means designed, to cut the resultant strip at its said transverse joints.

In combination with a known machine of this type there is also provided a label supply device and a continuous thread supply device, located upstream of the said machine, these also being of known type, in which the labels used to attain the results of the present invention include thermoplastics material and are V-shaped, and the continuous thread is of natural fiber.

The said natural fiber thread is shown by 4, from which pieces are successively cut, these pieces, in combination with the labels 5, may be applied to known filter bags for products to be infused. The thread 4, which is unwound from a spool supply device (not shown in detail), directed by a roller 6, descends along a guide channel 7 which, in a vertical plane, is inclined downwardly in the direction of the arrow F of feed of the thread 4.

At the upper end of this guide channel 7 which constitutes a first working station S1, the thread is inserted into and joined to the label 5 in a uniformly spaced succession, the labels being folded over into a V-shape, with their open portion directed upwardly.

Figure 2:
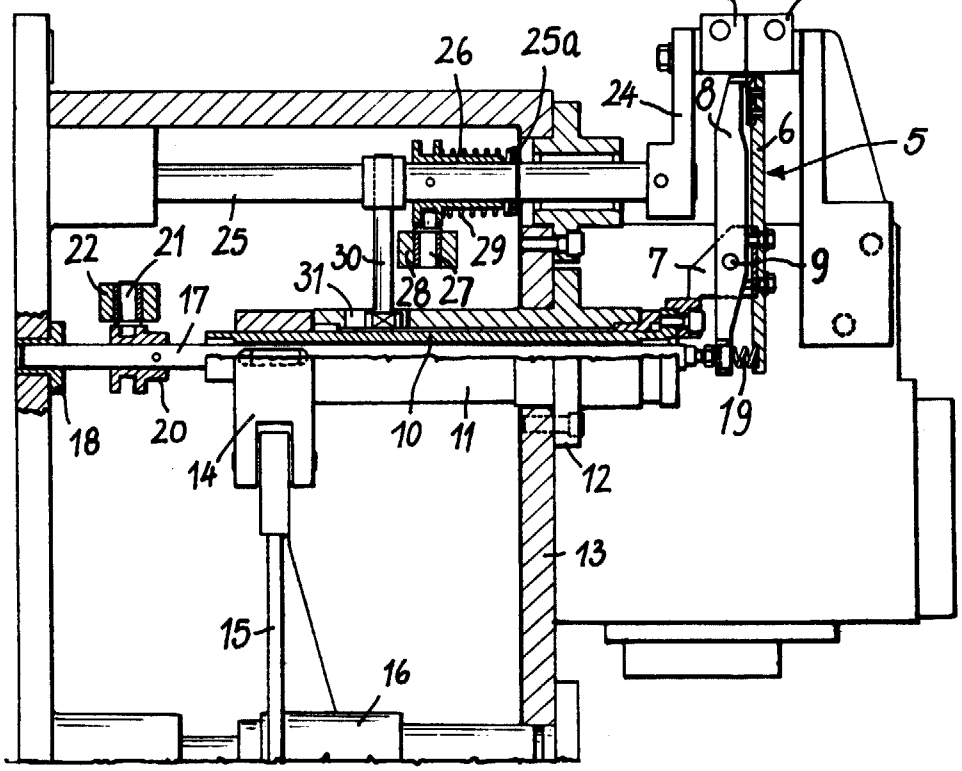
FIG. 2 is a longitudinal section of the first operating station for the application in uniform succession of the labels to the continuous thread.

In order to take the labels 5 from the label supply device (not shown in the attached drawings), there is provided a nipper indicated in its entirety by 8 and shown in detail, together with the elements designed for its actuation, in FIGS. 1 and 2. The nipper 8 is mounted to oscillate in the same vertical plane as the guide channel 7, below the thread 4, between a first position, shown by a broken line 8*a*, for taking a label 5, and a second position of the said label with the thread 4 between the limbs of the V-shape of the label. At this second position there are provided means for joining the two portions of the label, as will be described in detail in the following.

The two jaws of the nipper 8 are respectively constituted by a plate 9, fixed centrally on a square 10, and by a blade 11 which faces the plate 9 laterally, and is mounted on a pivot 12 which is mounted on the said square 10 (see FIG. 2). This square 10 is fixed at its front to one end of a tubular shaft 13 (see FIG. 2) which is rotatably mounted in a sleeve 14 and whose alternating rotation actuates the oscillation of the nipper 8. The sleeve 14 is fastened to the fixed base 3 of the machine by means of one of its flanges.

The tubular shaft 13 has, for the purposes of its alternate rotation, keyed onto it, externally to the sleeve 14, a crank 16 on which is hinged, about an axis parallel to that of the shaft, a connecting rod 17 whose base is mounted on a shaft 18 which may be rotatably actuated in alternate directions. Inside the shaft 13 a rod 19 is disposed coaxially and slidably, the said rod being supported at one end between a bushing 20 mounted on the fixed base 3 and acting with its other end on one end of the blade 11 of the nipper 8 in opposition to a helical spring 21 disposed in a compressed manner between the blade 11 and the plate 9 of the nipper 8. A tubular ring 22 is fixed on the rod 19, this ring having, shaped on its periphery, an engagement groove for a pin 23 projecting at right angles from a compensating lever 24 oscillating in a horizontal plane and designed to cause the axial displacement of the rod 19 so as to control opening and closing of the nipper 8.

The reciprocal joining of the two limbs of the V-shaped label 5 on the thread 4 is carried out at the station S1 by a pair of joiners 25*a* and 25*b*, the first of which is fixed, whilst the second is restrained, by means of a connecting arm 26 (see FIG. 2), to one end of a shaft 27, axially slidably supported parallel to the tubular shaft 13 of the fixed base 3. A bushing 28 is mounted on the shaft 27, this bushing having in its turn shaped on its periphery an engagement groove for a pin 29 projecting at right angles from a further compensating lever 30 oscillating in a horizontal plane and designed to axially displace the shaft 27 for the opening and closing of the movable joiner 25*a* on the fixed joiner 25*b*. Between an annular catch of the busing 23 and a catch ring 31 disposed on the side of the joiners 25*a* and 25*b* there is disposed a helical spring 32 designed to absorb the dosing thrust of the joiner 25*b* on the joiner 25*a* in such a way as to prevent any damage. There is also fixed at right angles on the shaft 27 a small rod 33 whose free end engages with an eyelet 14*a* formed longitudinally in the sleeve 14 to prevent the shaft 27 from rotating.

Downstream of the guide channel 7, substantially adjacent to the lower end of the latter, there is disposed a head or wheel 34 which is discontinuously rotatable and which comprises, substantially, four radial arms 34*a* disposed in accordance with the diagonals of a square in a vertical plane which is coincident with that of the guide channel 7. These arms, as will be described in detail in the following, are provided with means for displacing the thread 4 having a label 5 and at each rotation or movement of the rotatable head or wheel 34 of 90°, they carry out a corresponding feed movement of the thread 4. The rotary head or wheel 34 comprises a support 35 fixed, by means of screw means, to a flange 37 keyed in its turn to one end of a shaft 38 to which is transmitted, by means of a toothed wheel 39, the stepwise feed movement. The shaft 38 is inserted inside a coaxial sleeve 40, rotatably supported in its turn, by the interposition of known rolling bearings, on a hollow body 41 fixed to a portion 3*a* of the fixed base 3 of the machine.

A toothed wheel 42 is keyed, externally to the hollow body 41, on the sleeve 40, this wheel meshing with a toothed sector 43 fixed to one end or head of a connecting rod 44 whose base 44*a* is keyed on a shaft 44*b* for actuating with a rotary oscillating movement the said sleeve 40 in respect of the shaft 38 in a vertical plane at right angles to the shaft 38. The support 35 is shaped so as to have in a radial manner four plane projections 45 (see FIG. 4) along the said arms 34*a* of the rotary head or wheel 34, and the same number of plane projections 46 alternate to the first. The plane projections 45 and 46 lie on respective parallel planes at right angles to the axis of the shaft 38 and the first are frontally more external in respect of the second.

Respective plates 48 are fixed on the plane projections 45, by means of screw means 47, these plates having in their turn fixed to them and facing radially externally, respective pairs of sheets in close contact with one another and indicated by 49*a* and 49*b*. The sheets 49*a* and 49*b* are mounted by way of the plates 48 on the projections 45 of the support 35 and substantially constitute the end portions of the radial arms 34*a* of the rotary head or wheel 34 and define, peripherally between one another, grooves 50 and respective recesses 50*a* (see FIG. 1) in which the continuous thread 4 and part of the labels 5 are designed to be inserted. The means for taking the thread portion 4, upstream and downstream of each label 5, are provided on both sides of the recesses 50*a*.

These gripper means are of the nipper type, and are shown in their entirety by 51, 52, 53, of which 51 is downstream and 52 and 53 are upstream in respect of the direction of the arrow A of rotation of the rotary head or wheel 34. These nippers are constituted by portions of the frontally external single sheets 49*a* and by tongues 54, 55, 56 designed to come into contact with the sheet portions 49*a* and constituting the movable jaws of the nippers. Respective coaxial holes 52*a* are formed in the tongue 55 and the corresponding sheet portion 49*a* constituting the nipper gripping means 52.

The actuation of the nippers 51, 52 and 53 and more particularly the tongues 54, 55 and 56 are controlled synchronously by a tappet system actuated, as will be described in the following, by the alternating movement of the sleeve 40. This tappet system comprises an equalizer 57 constituted by a substantially triangular plate having one vertex in proximity to the shaft 38 and to which vertex are fixed the tongues 54, 55 and 56 meshing with the above-mentioned sheet portions 49*a* and relative to different and adjacent arms of the rotary head or wheel.

The equalizer 57 has a central aperture 57*b* and laterally to this aperture, on the rear face in respect of FIG. 1, two lugs 57*a* having coaxial holes. A pin 58 for articulation to a support 59 located in the aperture 57*b* is engaged in the holes of the lugs 57*a*. The equalizer 57 may be actuated by way of a peg 60 which is maintained in contact with the radially internal end 57*c* of the equalizer 57 by a cylindrical helical spring 61 disposed between the end of the equalizer 57 which is external in respect of the articulation pin 58 and the respective projection 46. The peg 60 is screw-threaded and is screwed axially into a rod 62 which is coaxial with it, this rod being slidably mounted, by the interposition of a suitable bearing, in a through seat formed in the support 35, with a parallel axis to that of the shaft 38. The rod 62 is actuated axially by a cam 63, by interposition of a roller 64, the cam being fixed to the said sleeve 40. A pin 65 projects radially from the rod 62 and engages in a longitudinal eye in the support 35, thus preventing rotation of the rod and maintaining the roller 64 in a tangential plane of rotation.

Corresponding to the position shown in FIG. 1 of the radial arm 34*a* having sheets 49*a*–49*b* of the rotary head or wheel 34, radially opposite to the arm adjacent to the lower end of the guide channel, there is provided a second cutting station S2 for cutting the thread 4 and for turning the label 5, in order to form a type of loop in the thread. The thread 4 is cut by a knife 66 which operated in cooperation with a counter-knife 67 in such a way as to cut the thread 4 downstream of the label 5, whilst the thread section 4 which precedes this is tensioned between the nippers which are further downstream, as will be explained in the following.

Figure 3:
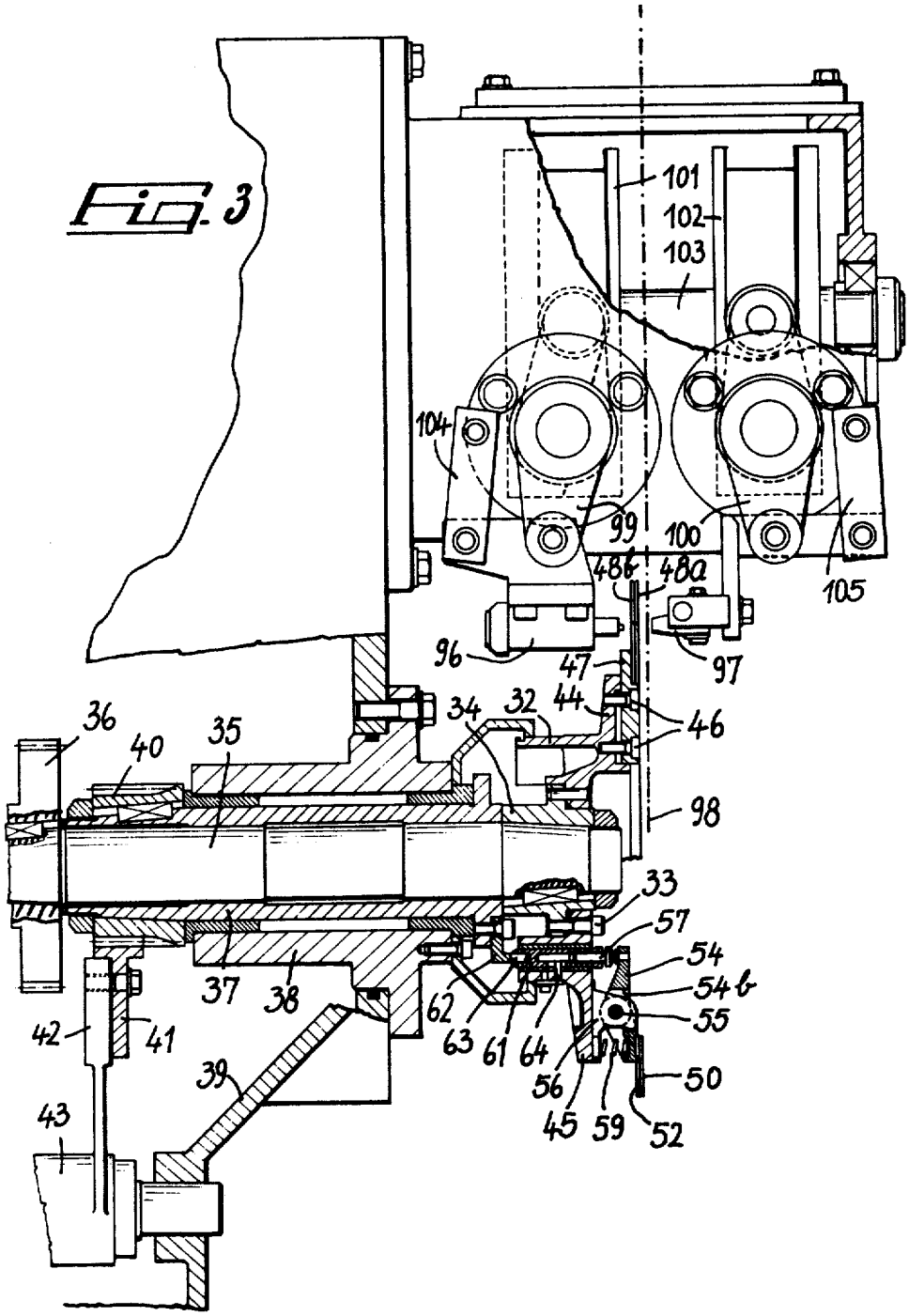
FIG. 3 is a section along line III—III of FIG. 1A showing the station for the cutting of the thread between successive labels.

The knife 66 (see FIGS. 1 and 3) is fixed to one end of a shaft 68 which is axially slidable inside a sleeve 69 which is rigid with the fixed base 3 of the machine by way of a flange 69*a*. The shaft 68 is actuated by an equalizer lever (not shown) meshing with a seat 70 contained in an enlargement of the shaft 68 at the end opposite to the end in which the knife 66 is fixed and is prevented from rotating by an arm 71 with which it is radially rigid and having its free end sliding in a groove 69*b* of a boss 69*c* fixed to the sleeve 69.

In order to upturn the label 5, after cutting of the thread 4, there is provided an oscillating arm 72 fixed, by means of a clamp 73, in the vicinity of one end of a metal tube 74 having its axis parallel to that of the shaft 38 of the rotary wheel 34. A narrow plate 75 having its free end folded at right angles in the form of a beak and which constitutes one jaw of a gripper element for gripping the label to be folded over is fixed to the oscillating arm 72 in a spring-mounted manner.

The other end of this gripper element is constituted by a rod 76, loaded by a helical spring 77 and mounted axially slidable and parallel to the metal tube 74, between a guide bushing 78 inserted and fixed to the oscillating arm 72. The spring 77 bears against an enlargement 76*a* of the rod 76, which enlargement has two parallel facets 76*b* on which is engaged a fork 79 supported rotatably at one end of a rod 80 inserted into the metal tube 74. The fork 70 is axially restrained on the said rod 80 by a piar of collars 80*a* and 80*b* rigid with the rod 80 and having antifriction bearings for the rotation of the fork 79. A needle or pin 81 projects frontally from the rod 80 and is eccentric in respect of its axis and acts as the spooling point of the thread 4 during the formation of the loop, as will be described in the following. A flange 82 is fixed at the opposite end of the rod 80 and provided with a seat in which a plate arm 83 is engaged, this arm being fixed to a sleeve 84 slidably mounted in a fixed guide shaft 85 having an axis parallel to that of the rod 80. Between the plate 83 and the flange 82 there is however a coupling which enables a longitudinal movement to be transmitted from the sleeve 84 to the rod 80.

The sleeve 84 is prevented from rotating by a rod 86 engaging with it and which projects at right angles from a projection 86*a* of the base 3. The sleeve is actuated along the shaft 85 by an equalizer lever 87 oscillatably pivoted in a vertical plane and controlled by a cam 87*a* so as to control the axial translation of the rod 80.

In order to actuate the oscillating arm 72 there is provided a hub 88 actuated by oscillating movement and provided with a radial arm 89 on which is fixed a toothed sector 90 for the transmission of the movement to a gear train constituted by a group of three toothed wheels 91, 92 and 93, the last of which controls, by way of the metal tube 74 to which it is rotatably associated, the oscillating arm 72. The first and second toothed wheels 91 and 92 are mounted freely, by means of bearings, on the shaft 85 and on a pin 94 which projects from an arm 95 fixed on the shaft 85 respectively.

On the toothed wheel 93 which is mounted rotatably and axially displaceable on the rod 80, there is fixed frontally a disc 96, through which the rod also passes axially, which disc is provided with a peripheral groove 97 which forms an axial cam in which a roller 98 engages and projects downwardly from a bracket 98*a*. This bracket is mounted rigidly on a sleeve 98*b* in which, with the interposition of antifriction bearings 98*c*, the metal tube 74 is axially and rotatably slidable.

The sleeve 98*b* projects externally from the fixed base 3 by way of an eye 3*b* and is provided with a flange 98*d* with which it is fixed to the base 3. The eye 3*b* and the holes of the flange 98*d* in which the fixing bolts 98*e* are engaged are extended to enable the displacement of the sleeve 98*b* parallel to itself so as to regulate the position of the axis of the rod 80 and to enable the loop forming point to be varied in terms of the lengths of the thread of the bag. The possibility of rotation of the rod 80 is prevented by the engagement of the end of the bracket 98*a* in a cut-out section 82*a* of the flange 82. The cam groove 97 is designed to cause the axial translation of the metal tube 74 so as to cause, during rotation of the oscillating arm 72, an axial displacement of the oscillating arm 72.

Downstream of the station S2 for folding over the label 5 there is provided a third working station S3 for application of the thread portions 4*a* having a label attached to them to the strip of filter paper 2 from which the known filter bags for infusion products are successively obtained. There are disposed in the station 53 suction means 99 designed to cause the said thread portions 4*a* having a label 5 attached to them to adhere to the strip 2 of filter paper during the operation of fixing them to the strip 2 by means of heating, as will be described in the following.

The suction means 99 have a box-like shape and are supported on a bracket 100 on the base 3 of the machine and adhere to the surface of the strip 2 coated with thermoplastic material which moves, in this case, in FIG. 1 vertically upwards in the direction of the arrow C in a plane adjacent to the radial arms 34*a* of the discontinuously rotatable head or wheel 34.

The box-like structure of the suction means 99 develops upwardly along two parallel arms 99*a* and 99*b* of different length lying in the vicinity of the longitudinal edges of the strip 2. The plane walls of the box-like parallel arms 99*a* and 99*b*, in front of which the strip 2 passes, are provided with suction holes 99*c* and opposite the arm 99*b* in this case of greater length than the arm 99*a*, the label 5 of the relative portion of thread 4*a* is located. A similar box-like structure is connected to a suction source of known type (not shown) comprising means for regulating the intensity of suction.

From the portion of the opposite surface of the strip 2 to that portion facing the suction means 99 there is provided an oscillating structure 101 aligning with the arm 99*a* and from bands opposite to the arm 99*b* of the said suction means 99, at different levels corresponding to the feed length or a multiple thereof of the strip 2, joining elements 102 and 103 designed to operate in combination with fixed joining elements 102*a* and 103*a* supported on the said bracket 100 (see FIG. 1).

The said oscillating structure is in its turn mounted pivotably by means of pins 104 and 105 at one end of two link rods 106 and 107, whose other end is rigid with a shaft 108 and respectively articulated by means of the pin 109 to the arm 110 of a sleeve 111 fixed to the base 3 of the machine inside which sleeve the shaft 108 is articulatedly mounted, the shaft being actuated by a cam within the base 3 (not shown in FIG. 1).

Figure 4:
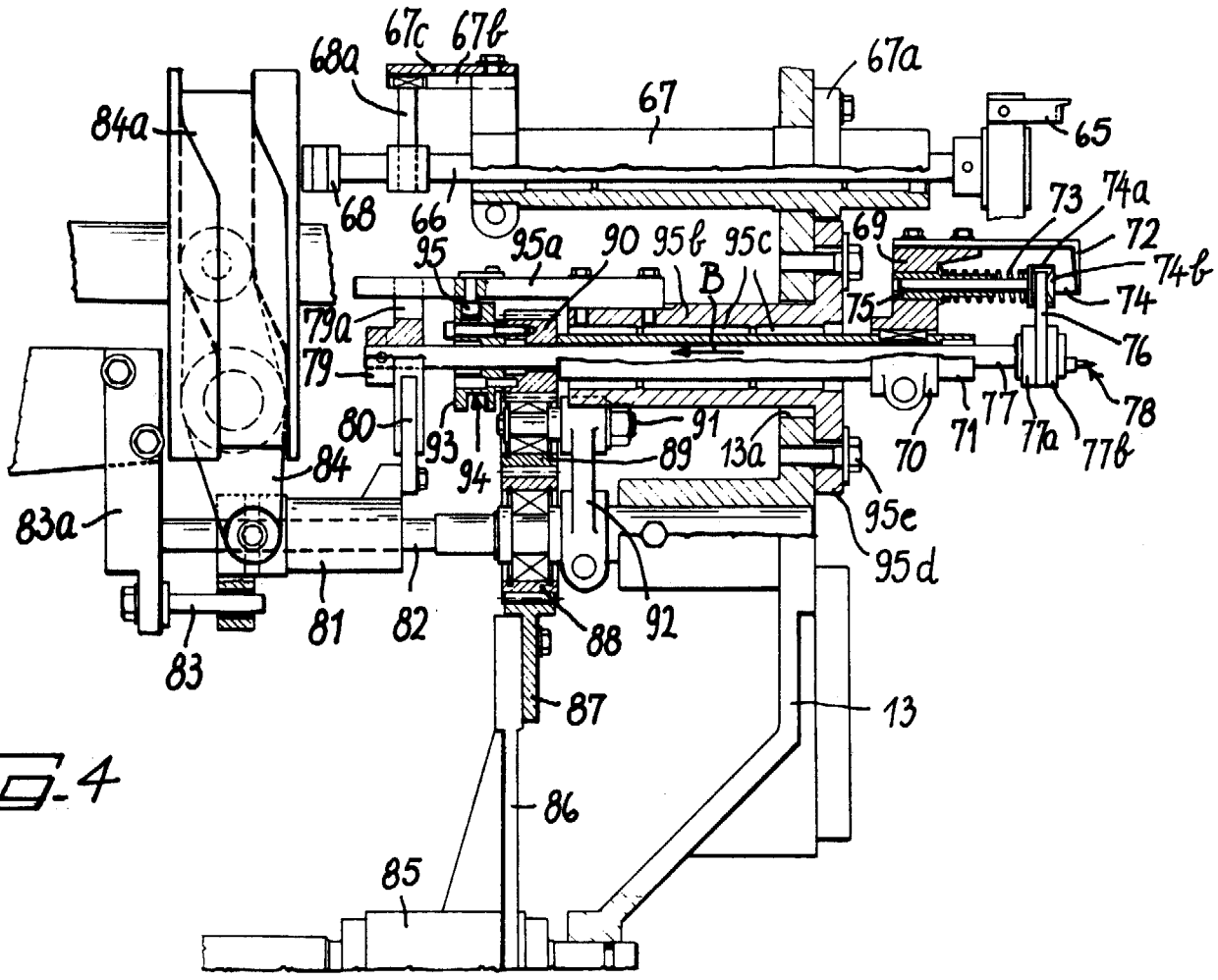
FIG. 4 is a section through a station for folding the thread about a respective label and the joining of the thread with the label to the filter paper strip.

According to a variant shown in FIG. 4, the joining elements 102, 103 and 102*a* and 103*a* are facing opposite sides of the strip 2 and are displaced against one another by respective equalizer lever means 112 and 113 pivoted at their intermediate point on the base 3 and having their upper ends provided with rollers which are guided in cams 114 and 115 keyed on a shaft 116. The equalizer levers 112 and 113 form together with the joiners 102, 103 and 102*a*, 103*a* and with further link rods 117 and 118 respective parallelograms articulated by the movement of the said joiners 102, 103 and 102*a*, 103*a* parallel to themselves. The said joiners carry out three joints, shown by 119, 120, 121 in FIG. 1, aligned along the thread portion 4*a* and transverse to the filter paper strip 2, the point 119 fixing one end of the thread portion to the strip 2, whilst the other two join points 120 and 121 fix the folded over thread portion to the opposite ends of the label 5.

The operation of the apparatus illustrated is as follows: The continuous thread 4 is fed stepwise by the discontinuously rotatable head or wheel 34, along the guide channel 7, whilst at the zone upstream of the guide channel 7, i.e. at the first working station S1, the nipper 8 inserts the V-shaped labels 5 on the said thread 4. In order to control the nipper 8, the equalizer lever 24 which, by means of the rod 19 controls the nipper opening, and the shaft 18 which, by acting on the tubular shaft 13, determines its rotation, are provided. The nipper opens in the position 8*a* (see FIG. 1) for taking the label 5 (provided flat and at a desired frequency by the feed device which is not shown) in order to then close in the proximity of the folded edge in order to effect the angular rotation.

At the end of this last step, the equalizer lever 30 controls, by acting on the shaft 27, the closing of the joiner 25*b* against the fixed joiner 25*a* so as to fix the two facing limbs of the V-shaped label 5 on the thread 4. The thread 4 with the labels attached to its at uniform distances continues along the guide channel 7 and winds peripherally about the radial arm 34*a* of the rotary wheel 34 in the thread guide groove 50 on each of the radial arms 34*a*, as can be seen in FIG. 1, in order to hold the thread and prevent it from escaping laterally.

The winding of the thread on the radial arms 34*a* is provided by the intermittent rotation, in the direction of the arrow A, of the rotary head or wheel 34 which, at each step, completes an angular displacement of 90° carrying labels 5 to be inserted in a corresponding recess 50*a*.

For a more detailed explanation of the operating steps, it is supposed that the instantaneous rest position shown in FIG. 1 has been attained in which the thread 4 is held by the nippers 52 and 51 in a stationary manner at the working station S3, i.e. relative to the thread section 4 which is horizontal above the joining location, whilst the corresponding upstream, lateral and lower nippers are open. In this instantaneous rest position the strip 2 which, as stated above is fed continuously, is prevented from moving continuously by oscillating roller recall means so as to create a reserve spool of the strip 2 which is then used up during the subsequent intermittent rotation of the wheel 34. The said means comprises two free, rotatably mounted, rollers 122 and 123 upstream and downstream respectively of the wheel 34 and onto which the strip 2 winds.

The roller 122 is supported on a pair of arms 123 oscillatably supported by the base 3 of the machine about a respective horizontal pin 125, whilst the roller 123 is supported by a pair of arms 126 rigid with a shaft 127 oscillatably supported on the said base 3. The two free rollers 122 and 123 are interconnected by a rod 128 articulated at its opposite ends on the horizontal axes which freely rotatably support the rollers 122 and 123. The end of a lever 129 is fixed to the shaft 127, the other end of which lever connects with a known articulated lever system (not shown) for the transmission of the oscillating movement to the shaft 127 and thus to the free rollers 122 and 123 for the formation of the spool of strip 2 to be taken up, as stated above, in the subsequent intermittent rotation step of the discontinuously rotatable wheel 34 for the stepwise feed of the strip 2.

At the outset of this instantaneous rest condition of the discontinuously rotatable head or wheel 34, the beak of the step plate 75 and the rod 76 forming the gripper element at the working station S2 are spaced from one another and the label 5 located at the station S2 is inserted between them. The gripper elements 75–76 then closes the label 5 and immediately before this the closure of the lower nippers 51, 52 on the thread 4 takes place. The closure of the gripper element 75–75 is controlled by the cam 87*a* which, by means of the equalizer lever 87, urges the sleeve 84 and therefore the rod 80 outwardly (to the right in FIG. 3) enabling th spring 77 to displace the rod 76 against the opposite beak of the step plate 75 to grip the label. At the same time the pin 81 penetrates the holes 52*a* of the nipper 52 opposite to it making the thread 4 available on the external side. The closure of the said lower nippers 51, 52 is however controlled by the cam 63 caused to rotate by the sleeve 40 actuated by the hub 44*a* by way of the gear train 43 etc. The cam 63 enables the axial displacement of the rod 62 on which, by way of the peg 60, it presses the end 57*c* of the equalizer 57 under the action of the spring 61. At this point the thread is cut by means of the knife 66 actuated by the equalizer lever 70.

With the lower nippers 51, 52 closed, the joining of the upper portion 4*a* of the thread transversely to the filter paper strip 2 takes place by means of the joiners 102–102*a* and 103–103*a*. The fastening of the upper section 4*a* of thread takes places, as stated above, at three points 119, 120, 121, with the end portion of thread between the knife 66 and the join point 119 momentarily hanging down, until suitable elements (not shown) disposed downstream of the said joiners 102–102*a* and 103–103*a* in respect of the direction of feed of the arrow C of the filter paper strip fold it onto the opposite surface to that at which the label is applied and join it in the vicinity of the edge of this surface.

As soon as the lower nippers 51, 52 are closed and the thread 4 has been cut, rotation of the gripper organ 75,76 in the direction of the arrow D takes place under the action of the hub 88 and by way of the gears 90, 91, 92 and 93. During this rotation the label 5 is taken from the relative recess 50*a* to the station S2 and inserted between the elements which form the most upstream nipper 53, according to the position shown by 5*a* in FIG. 1. In the meantime the thread 4 is folded parallel to itself by winding it about the pin 81 so as to form a type of loop, whilst during the rotation of the gripper element 75–76, the thread tensioner 130 displaces from its plane the section of thread 4 upstream of the nipper 53 so as to facilitate the insertion of the label in the said nipper 53.

A slight inclination of the grip surfaces of the label, i.e. the surfaces facing the rod 76 and the beak of the step plate 75 thus enable the label, at the end of rotation, to be maintained adjacent to the thread with one of its edges, in order to ensure the accuracy of gripping by the nipper 53.

Once the loop has been formed, the rotary wheel 34 carries out a further rotation of 90° in the direction of the arrow A and at the same time as this, under the action of the cam 63, the lateral nippers 51, 52 and 53 at the station S2 close to grip the label and the thread, whilst the corresponding upper nippers at the station S3 open to position the thread on the filter paper strip and the gripper element 73–77 returns to the starting position in the opposite direction to the arrow D.

At the beginning of this rotation the displacement of the rod 80, controlled by the cam 97, determines the entrainment of the rod 76 by way of the fork 79 and the consequent opening of the gripper element 75–76 and the unthreading of the needle 81 by the loop. At the end of the rotation of 90° in the direction of the arrow A of the rotary wheel 34, the thread section 4 which was firstly in a vertical position is disposed horizontally and transversely behind the filter paper strip 2 caused in the meantime to advance by one step.

The horizontal lower section is therefore vertically flat and a new thread section 4 is taken from the guide channel 7 and positioned to be gripped by the lower nippers 51, 52. The cycle illustrated is then repeated in the way described above.

Upstream of the rotary head there is therefore a paper strip provided at uniform distances with sections of thread 4*a* to which the label is fastened which continues to adhere to the strip by way of the section exerted on the strip along the suction portion 99*b* up to the vicinity of the roller 123 for a period sufficient to ensure the joining of the thread to the strip.

The formation of bags from a strip provided in this way with thread portions 4*a* having a label attached takes place in a known way, by folding the paper longitudinally in half and then joining it transversely so as to form bags which are open on one side to enable the insertion of the product and finally by closing and separating the bags.

As can be seen the invention provides a perfect solution to the cited aims. The appartus is in particular suitable for use at high operating speeds, much higher than those of present machines for the same purpose. This speed is a direct result of the possibility provided by the individual components of carrying out oscillating movements of reduced rotation, and by comparatively reduced dimensions of its components with a consequent reduction of moving masses and therefore of the corresponding forces of inertia.

I claim:

1. In an apparatus for the application of a suspension thread of natural fibers having a label attached to it to a strip of filter paper in a machine for the automatic production of filter bags of an infusion product operating in conjunction with a label supply device, the filter paper strip having on one of its surfaces a light coating layer of thermoplastic material, the apparatus comprising means for continuously supplying the strip of filter paper along a working line and, disposed along the latter, folding means for folding the strip of paper into two symmetrical half sections, having the thermoplastic material coated surfaces facing one another along a longitudinal median line, dosing means for supplying discrete quantities of the infusion product at uniform distances to the folded strip, joining means for joining by means of heating the said folded strip transversely between the quantities of infusion product at uniform distances and along the opposite longitudinal edges, and means for cutting the strip at the said transverse joints, and the labels comprising thermoplastic material and being V-shaped, the improvement which comprises:

a rotary head having radial arms to be disposed downstream of the label supply device, with its front portion behind the strip of filter paper, each radial arm being associated in the plane of rotation of the head with thread-guide means and a series of three nippers, one downstream and two upstream in respect of the direction of rotation of the rotary head;

means for rotatably actuating the rotary head intermittently;

means for intermittently halting the filter paper strip in synchronism with intermittent halting of the rotary head;

means for causing the series of nippers to open and close;

guide channel means joined in a coplanar manner between the thread-guide means and the nippers of the arms of the rotary head, for communication with the label supply device;

a first working station comprising means for nipper joining being provided along the guide channel means;

supply means for supplying a continuous thread to the thread guide means, between the nippers located between the joining means and through the guide channel means;

first oscillating nipper means for taking, under the action of control means, in uniform succession, single V-shaped labels from the label supply device and to transfer them to the first working station between the nipper joining means, with the continuous thread being between the V-shaped limbs of the labels;

means for actuating the nipper joining means in order to fix, by means of heating, the labels to the continuous thread, the labels being thereby fixed to the continuous thread and being caused to move, by two of the three nippers, between the thread guide means of each radial arm as a result of the intermittent movement of the rotary head and thus being disposed in the plane of rotation between the said two nippers; and second and third working stations operating along the path of rotation of the rotary head at one of the radial arms and respectively between two successive radial arms facing the strip of filter paper in the rest position of the rotary head, said second working station comprising cutting means designed to cut the continuous thread downstream of the two nippers, pin means movable perpendicularly to the plane of rotation of the rotary head adapted to intersect, under the action of control means, the plane of the thread externally to the thread at the nipper upstream of the said two nippers, thread tensioning means designed to move the section of thread upstream of the third nipper from its plane, and second oscillating nipper means designed, under the action of control means, to grip the label between the said two nippers and to oscillate with a movement which is opposite to that of the rotary head, thus inserting the said label between the prongs of the said third nipper and winding the thread about the said movable pin means, the third working station comprising suction means extending along the path of the filter paper strip designed, by means of suction across the filter paper strip to cause the thread to adhere to the strip at the area of the label and at least one other point upstream of the label, and joining means of a movable type designed, under the action of control means, to heat the said two areas at which the thread adheres to the filter paper strip, causing localized impregnation of the thread with the thermoplastic material of the coating layer of the strip by diffusion through the filter paper as a result of the heating operation.

2. The improvement defined in claim 1 in which each radial arm of the rotary head is formed at its free end of the head, with one of its sides tangential to the path described by the rotation of the head, a groove open peripherally along the thickness of the said side having an intermediate section of greater radial depth constituting the thread guide means and, respectively, a chamber or recess for containing a label attached to the continuous thread, the said plate-like portion having laterally and coplanar with it both upstream and downstream in the direction of rotation of the head one and two projections constituting a respective fixed jaw of the said three nippers, the other movable jaw of the three nippers connecting with equalising elements provided between the adjacent radial arms and actuated by the said tappet means for actuation of the opening and closing movements of the nippers.

3. The improvement defined in claim 1 in which the rotary head comprises a support fixed on a rotary shaft and having four radial arms angularly spaced by 90° and each provided peripherally with a recess for the insertion of a label, the nippers for gripping the rear and front end of the adjacent sections of thread being disposed upstream and downstream of the label, on the sides of the said recess.

4. The improvement defined in claim 1 in which the said means for causing the nippers to open and close are supported by the rotary head between its radial arms and are controlled synchronously with the rotation of the head, by cam means.

5. The improvement defined in claim 1, claim 2, claim 3 or claim 4, in which said suction means has a box-like shape and extend in the said third working station along the path and with one of its plane faces in the vicinity of the filter paper strip radially externally to the rotary head, the wall constituting this plane face having a plurality of holes for suction, and the said box-like suction means connecting with a source of suction comprising means for the regulation of the suction intensity.

* * * * *